United States Patent [19]

Varley

[11] Patent Number: 4,518,048

[45] Date of Patent: May 21, 1985

[54] METHOD FOR IMPROVED HYDRAULIC JETTING OF DRILL BORE HOLES USING HIGH PRESSURE PULSES OF FLUID

[75] Inventor: Robert F. Varley, Metairie, La.

[73] Assignee: Robert F. Varley Co., Inc., Gretna, La.

[21] Appl. No.: 486,220

[22] Filed: Apr. 18, 1983

[51] Int. Cl.[3] ..... E21B 7/08; E21B 7/18; E21B 10/18

[52] U.S. Cl. ..... 175/61; 175/67; 175/320

[58] Field of Search ..... 175/61, 65, 67, 234, 175/235, 237, 242, 321, 324, 317, 318; 166/317, 318; 239/101, 102

[56] References Cited

U.S. PATENT DOCUMENTS

| | | | |
|---|---|---|---|
| 2,987,130 | 6/1961 | McIntyre | 175/318 |
| 3,087,558 | 4/1963 | Dougherty, Jr. | 175/65 |
| 3,195,660 | 7/1965 | McKown | 175/65 |
| 3,369,619 | 2/1968 | Brown | 175/317 |
| 3,599,733 | 8/1971 | Varley | 175/61 |
| 3,645,331 | 2/1972 | Maurer et al. | 175/237 |
| 3,804,182 | 4/1974 | Adair et al. | 175/237 |
| 3,815,692 | 6/1974 | Varley | 175/65 |
| 3,993,974 | 11/1976 | Silverman et al. | 181/102 |
| 4,341,272 | 7/1982 | Marshall | 175/65 |

*Primary Examiner*—Stephen J. Novosad
*Attorney, Agent, or Firm*—Cushman, Darby & Cushman

[57] ABSTRACT

Disclosed is a method for generating high-pressure drilling fluid pulses through the nozzles of a directional or "straight ahead" drill bit. One or more balls characterized by a critical compressional force are caused to seat in a jetting nozzle and block it. The pressure in the drill string is then caused to exceed the critical compressional force of the ball such that the ball is blown through the nozzle orifice followed by a bullet-like fluid pulse. A preferred embodiment occurs when the drill bit is attached to the drill string by an extensible hydraulic piston section. The invention has particular application with regard to directional drilling wherein it is desired to deviate the bore hole from a straight vertical path.

4 Claims, 4 Drawing Figures

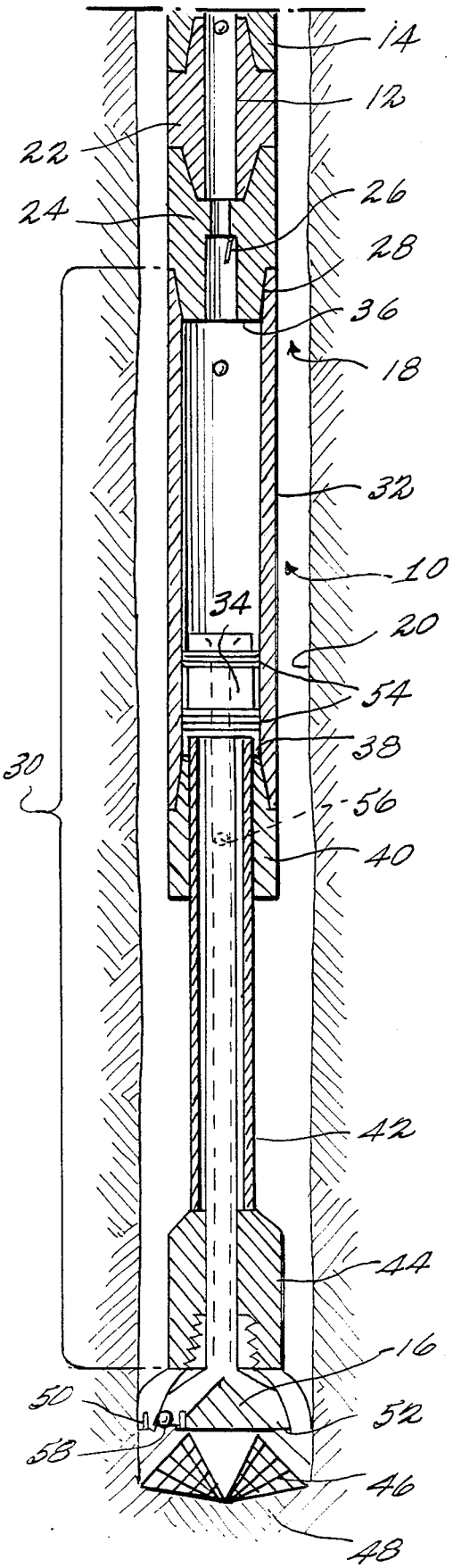
FIG. 1
FIG. 2
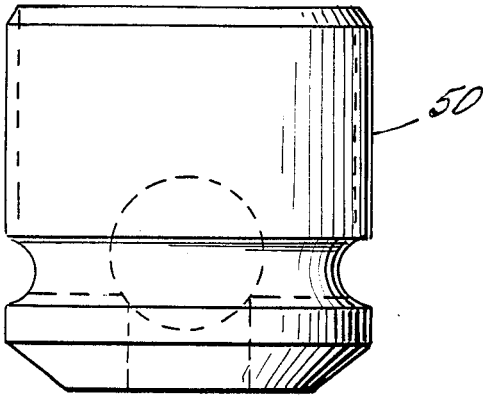

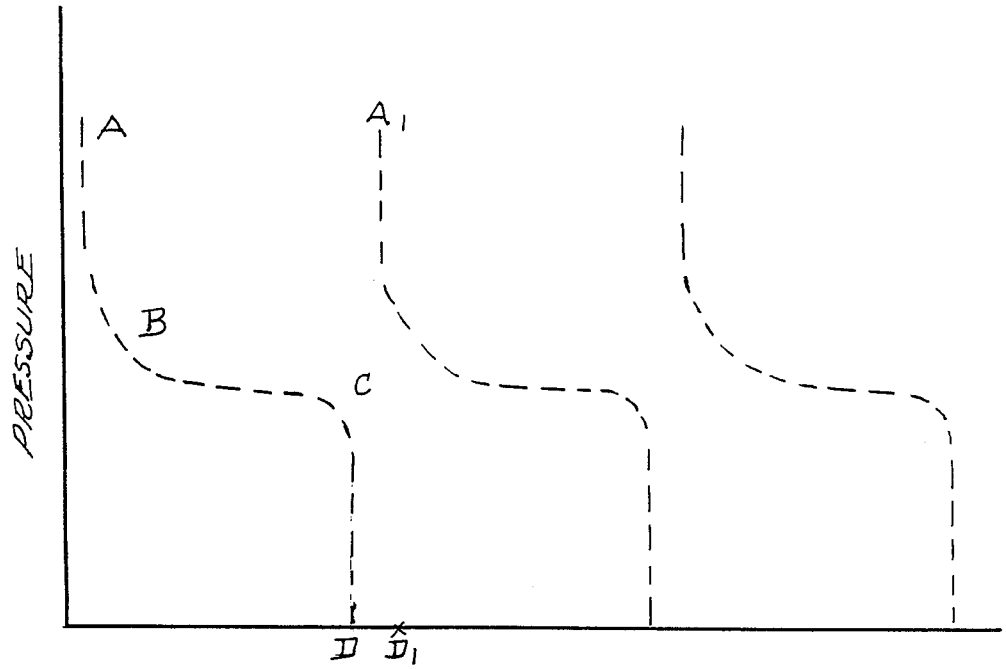

BALL JETTING CYCLE (TIME)

A— CHAMBER PRESSURE RIGHT BEFORE CRUSH OF THE PLUG (BALL CRUSH PRESSURE
A-B CHAMBER PRESSURE AFTER THE PLUG CRUSHES (HI VELOCITY JET EJECTION)
B-C CHAMBER PRESSURE DURING JETTING BULK OF THE CHAMBER (NORMAL VELOCITY JET).
C-D CHAMBER PRESSURE EQUATES STATIC BOTTOM HOLE PRESSURE; BEGINING NEW CYCLE.

FIG. 3

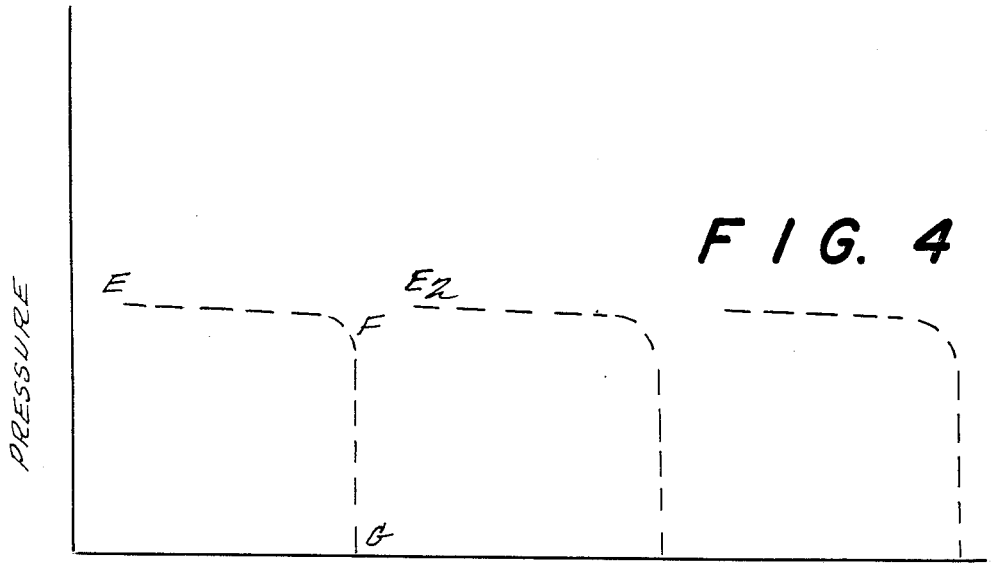

FIG. 4

NORMAL JETTING CYCLE (TIME)

E-F CHAMBER PRESSURE DURING JETTING.
F-G CHAMBER PRESSURE EQUATES STATIC BOTTOM HOLE PRESSURE; BEGINNING NEW CYCLE.

METHOD FOR IMPROVED HYDRAULIC JETTING OF DRILL BORE HOLES USING HIGH PRESSURE PULSES OF FLUID

FIELD OF THE INVENTION

This invention relates generally to the drilling of well bore holes such as in the drilling of oil wells, and, more specfically, it relates to a method of creating high pressure hydraulic fluid surges which greatly enhance the erosion of the bore hole and thereby facilitate the drilling operation. The invention is particularly suited to directional drilling techniques whereby a bore hole is deviated at an angle from a straight vertical path.

BACKGROUND OF THE INVENTION

A conventional drilling rig comprises a drill string composed of drill pipes and drill collars and having at its lowermost end a drill bit provided with a bit cone used to cut the rock formation into which a bore hole is being drilled and also fluid ejection means to erode the rock formation as the drill bit is lowered and to wash the cuttings away. The fluid ejection means generally comprises one or more nozzles in the drill bit through which hydraulic fluid such as drilling mud is pumped under pressure from a mud pump located on the surface (i.e., above ground) of the drilling rig. After the drilling mud has been expelled through the nozzle orifices it is conducted through an annular region concentric with the drill string back to the surface of the drill rig wherein it is separated from particulate matter such as shale and repumped back through the drill string.

Given the redoubled efforts which have been taking place recently in an effort to locate new oil deposits due to the ever increasing cost of petroleum and petroleum products, it has become necessary to drill new wells to greater and greater depths through all manner of rock formations. In working at these greater depths it is, as well, important to be able to control the direction taken by the drilling apparatus. That is, it is often necessary to deviate the bore hole at an angle from a straight vertical path to get to a particular deposit. This technique is particularly important in off-shore drilling where it is desirable to place as few production platforms as possible while yet having the ability to drill throughout and produce from as wide an area as possible.

Deep wells pose serious obstacles, however, which limit the effectiveness of the erosion capability of conventional drilling systems due to the opposing hydrostatic pressure of the drilling mud once it has been ejected through the drill bit nozzle orifice. Hydrostatic pressure here refers to the fact that drilling mud, once it has left the drill string, exerts what is in effect a static back pressure against the drilling mud which is being ejected from the drill bit. This downhole pressure is essentially equal to $\rho H$ where $\rho$ is the density of the drilling mud and H is the height of the annular mud column, equal to the vertical depth of the bore hole. Thus it can be seen that hydrostatic pressure which jetting drilling mud must counteract linearly increases with increasing vertical depth of the bore hole.

Thus in the art of oil drilling strenuous attempts have been made to discover new means whereby the velocity of hydraulic drilling fluid jetted through drill bit nozzles can be increased such that the erosional and directional capabilities of the drilling system as a whole can be correspondingly increased. For example, in my prior U.S. Pat. No. 3,599,733, herein incorporated by reference, I have described a method for enhanced directional jet drilling utilizing a reciprocatable in-hole mud pump located relatively adjacent to a directional jetting bit in the drill string, which bit has at least one fluid outlet orifice through which a relatively greater amount of drilling mud can be caused to flow than through other bit orifices. In essence, this inhole mud pump comprises an extensible cylinder and piston section having a back pressure operated fluid valve at the top thereof. In the technique described in my prior patent, this extensible section is first fully extended to fill the cylinder with mud after which the drill string is lowered, thus trapping the cylinder full of mud behind the back pressure valve resulting in increased compressional forces to force the mud out of the jetting bit at an increased velocity. By having one relatively larger nozzle in the bit disposed relatively adjacent the vertical bore hole wall, the bore may be deviated in a direction corresponding to the position of that nozzle.

Similarly, in my prior U.S. Pat. No. 3,815,692, also herein incorporated by reference, I apply the same general principles as in U.S. Pat. No. 3,599,733, but therein the drill string is disclosed to be constructed to include an extensible hydraulic cylinder and piston section located above a drill bit positioned at the bottom of the drill string and wherein the drilling system may include any kind of conventional jetting and/or other drilling bit. The extensible section is positioned in a partially retracted or less than fully extended position such that substantially the whole force urging the drill bit against the bottom of the bore hole comprises the hydraulic force generated within the extensible hydraulic cylinder and piston section when pressurized fluid is admitted into that section and trapped therein by means of a check valve located at the top thereof. Whatever force is applied to the trapped pressurized fluid by slacking off on the surface vertical drive means controlling the amount of drill string weight allowed to urge the bit against the bore hole bottom is transmitted to the bit. The pressure may be maintained by compressing the extensible section for the distance of available travel, all the while jetting drilling mud at increased velocity over that obtainable in the absence of said extensible portion to erode the hole with increased efficiency.

The reciprocatable down-hole mud pump (of the type sold by the R. F. Varley Co., La., under the trademark "HJD") described above from U.S. Pat. No. 3,815,692 is hereinafter sometimes also referred to as the "down-hole pump". Viewed alternatively from the description given above, when the down-hole pump is reciprocated it works like a pump, filling its top part with drilling mud as it is opened and ejecting the mud from one or more bit nozzles as it is closed (i.e., telescoped or compressed inwardly on itself). The ejection pressure is a direct function of the speed with which the pump is closed, higher pressures of course yielding more effective mud jets.

The jetting bit itself usually has one large nozzle (e.g., $\frac{3}{4}$ inch), the jetting nozzle, and two smaller nozzles (e.g., $\frac{1}{4}$ inch) which are blanked out if jetting is to be done at depths exceeding 5,000 feet.

In spite of advancements such as the ones described above for increasing the velocity of jetted drilling fluid, new and/or improved means for even further enhancing hydraulic jetting velocities are constantly being sought and, to the extent that they are discovered, improved drilling systems, straight ahead or directional, can be developed which will permit drilling to deeper and deeper depths. Such a technique is the subject of the present invention.

SUMMARY OF THE INVENTION

This invention creates high pressure fluid pulses by temporarily obstructing a fluid outlet while it is pressurized to a higher level. Thereafter, the obstruction is suddenly removed and the result is a high pressure pulse of drilling fluid.

This invention makes possible such increased fluid jet velocities in an exemplary embodiment by adding to the drilling mud at preselected intervals groups of one or more "balls" (or other shaped obstructions, e.g., multifaceted spheroids, etc.) which function to temporarily plug one or more of the bit nozzle orifices, thereby causing pressure to build up within the drill string, or down-hole pump if one is being used. The balls are characterized by a critical compressional force above which they are frangible, shearable, disintegrable, or otherwise crushable such that, when seated in a nozzle, they are suddenly crushed and blown through the nozzle with a high pressure pulse of mud when said critical compressional force is exceeded. The effect of suddenly disintegrating the ball is to release the pressure which has built up inside the drill string or down-hole pump such that drilling mud which had been trapped during the period of pressure buildup is now released to exit through the nozzle orifice as a "fluid bullet" at desirably higher pressure, thereby increasing the erosional capability of the drilling system. As will be described, the balls may be constructed to have any disintegration pressure desired within a wide continuum of such pressures such that a drilling system can be tailored to the exact type of formation being drilled simply by selecting a ball characterized by the appropriate compressional force.

It is therefore an object of this invention to provide a method which will significantly increase the velocity of drilling fluid jetted through a drill bit nozzle orifice.

The aforementioned and other objects, as will be apparent to one of skill in the art, may be obtained by using the invention described herein which may be understood in more detail by reference to the detailed description given below of a presently preferred exemplary embodiment of this invention taken in conjunction with the accompanying drawings in which:

FIG. 1 is a diagrammatic illustration of a preferred embodiment of drilling apparatus to carry out the method of this invention.

FIG. 2 is an enlarged view of a ball as described in this invention seated in and obstructing the jetting nozzle of a drill bit.

FIG. 3 is a graphical illustration showing how pressure varies in a drill string equipped with a down-hole pump through a cycle in which a ball seats in a drill bit nozzle, crushes and blows through the nozzle, and as the subsequent fluid surge equilibrates with static bottom hole pressure.

FIG. 4 is a graphical illustration showing a normal jetting cycle which takes place in a drill string which is equipped with a down-hole pump used in the absence of the modified techniques afforded by the crushable balls of the present invention.

DETAILED DICUSSION

The invention will now be described with particular reference to the down-hole pump of the aforementioned U.S. Pat. No. 3,815,692 which represents a presently preferred exemplary embodiment of a drilling system for use with the present invention.

As shown in FIG. 1, a bore hole is shown generally at 10 into which drill pipe 12 (fitted with drill collars 14 as needed and having at its lower end a down-hole pump 30) and drill bit 16 (shown for exemplary purposes as a directional jetting bit) has been lowered. As shown in FIG. 1, the diameter of drill bit 16 is larger than the diameter of drill pipe 12 such that the drill string is substantially concentrically located within bore hole 10 and such that there is an annulus 18 between the bore hole wall 20 and the outside diameter of drill string 12 (e.g., for returning the drilling mud to the surface). Drill pipe 12 is fitted on its lowermost portion with drill collar 14 which is connected at its lower portion to double pin sub 22 which in turn is connected at its lower portion with back pressure sub 24, which serves as a heavy wall housing for a plug or, as shown in FIG. 1, flapper valve 26. Back pressure sub 24 is in turn connected as at 28 to down-hole pump 30. Down-hole pump 30 essentially comprises a barrel member defined by the internal diameter of mandrel body 32 within which a piston member shown as packing assembly 34 is disposed and capable of slidably travelling the length of the mandrel for a distance bounded upwardly by lower shoulder 36 of back pressure sub 24 and downwardly by upper shoulder 38 of hex drive sub 40. Attached to packing assembly 34 and substantially concentric with mandrel body 32 is a second mandrel body 42 which is hexagonally shaped and which defines a fluid passageway for the drilling fluid and which terminates in lower member 44 which is engaged with the upper portion of drill bit 16. Drill bit 16 is conventionally constructed with bit cone 46 to cut through the formation rock as at 48 and with jetting nozzle 50 and bit nozzle 52 through which drilling mud impinges against bore hole wall 20 thereby facilitating directional drilling after the drill string has been suitably oriented such that jetting nozzle 50 is suitably positioned laterally adjacent the bore hole surface wherein it is desired to deviate the bore hole. Of course, if directional drilling is not desired, increased erosional efficiency may be obtained by employing a "straight-ahead" jetting nozzle and rotating the drill string. In this regard, mandrel 42 is hexagonally shaped to fit within the hexagonal passageway within hex drive sub 40 such that rotary motion from a rotary table located on the surface which imparts rotational motion to the drill string can controllably transmit said rotational motion to extensible down-hole pump 30 so that drill bit 16 may be rotated to aid in cutting the formation rock. As shown, packing assembly member 34 is suitably fitted with packing rings 54 or with other conventional sealing means to prevent leakage of drilling fluid past said packing assembly member.

A series of crushable balls is shown descending through the drill string and down-hole pump section, as at 56, ultimately to seat in jetting nozzle 50 of drill bit 16, as at 58. As will be hereinafter explained, the ball is advantageously timed to seat in the nozzle orifice at the instant when extensible section 30 has been fully extended. At this instant the reciprocating drill string will begin its travel to recompress extensible section 30 and flapper valve 26 will close trapping a volume of drilling mud between flapper valve 26 and the ball seated in nozzle 50. As weight from slacking off the drill string is applied to down-hole pump 30 it closes and the mud trapped therein is compressed under a force equal to that portion of the weight of the drill string being applied thereto. As soon as that pressure meets or exceeds the compressional force which characterizes the disintegration pressure of the crushable ball, said ball is crushed or imploded, i.e., forcibly blown through nozzle 50 followed by a fluid bullet as the compressed drilling mud in pump 30 instantaneously tries to reequilibrate itself with the hydrostatic downhole pressure at the bit. Thus those skilled in this art can appreciate how the down-hole pump (described in the aforementioned U.S. Pat. No. 3,599,733) can be used in conjunction with the disintegratable balls 56 to periodically build up pressure in the trapped drilling fluid even beyond that capable of being achieved by the down-hole pump alone in the absence of said balls and how enhanced jetting action results.

The distance between balls as they drop through the drill string may be important inasmuch as the jetting method is optimized when the balls are so distanced that a ball has seated as at 58 each time pump 30 is lifted and fully extended. A means for achieving this distance on a fairly precise basis can be illustrated by a simple calculation, as follows. Assuming that the down-hole pump has just started its downward travel and the flapper valve has closed and there is no backflow of mud through the nozzle, dividing the internal volume of the barrel (12.2 gallons = 1.6309 cu.ft. for one typical down-hole pump) by the cross-sectional area of the drill pipe will yield the optimum distance between the balls. For a 4 ½" drill pipe, for example, the ID is 3.826" and the cross-sectional area is 11.497 sq.in. = 0.0798 sq.ft. Thus the optimum distance between the balls can be simply calculated as about:

$$\frac{1.6309\ \text{ft}^3}{0.0798\ \text{ft}^2} = 20.5\ \text{ft.}$$

When a particle (e.g., the ball) moves in a fluid, the fluid exerts a drag force on the particle. If the particle is falling, there are three forces acting on the particle—(1) the weight of the particle (gravitational force) which is in the direction of flow (i.e., downward); (2) the buoyancy force which acts opposite to the direction of flow (i.e., upward); and (3) the fluid drag force which is also upward. When the particle first starts to fall, it accelerates until the sum of the upward forces is balanced by the downward forces, i.e., until the sum of all forces acting on the particle is zero. At this point, the particle stops accelerating and continues to fall at a constant speed, which will be its maximum velocity. This velocity, referred to as the terminal or settling velocity, is a function of the Reynolds number and for the present case, it can be calculated by the following equation:

$$V_t = 1.74\sqrt{\frac{gD_p(\rho_p - \rho)}{\rho}}$$

where:

$D_p$ is the diameter of the ball in feet, $\rho_P$ is the density of the ball in lb/ft$^3$, g is the local acceleration of gravity (32.17 ft/sec$^2$), and $\rho$ is the drilling fluid density in lb/ft$^3$ Thus, for purposes of illustration, if the ball has a diameter of 1.25 in., a density of 30 lb/gal, and if the mud has a density of 11 lb/gal and a viscosity of 41 centipoise, the terminal velocity of the ball calculates out as 4.18 ft/sec. Therefore, for the balls to be distanced about 20 ft. apart, another ball should be dropped into the drill string about every 5 seconds.

The balls can enter the drill string by any of a number of suitable valving configurations or, very simply, by being mechanically dropped into the string by hand or, advantageously, by a suitable mechanical device timed to release a ball at predetermined intervals, as calculated above. The surface of the drilling rig generally comprises a drilling fluid reservoir and a mud pump which communicates with the drill string by means of a Kelly bar which serves to couple the circulating drilling mud with the string. By uncoupling the Kelly bar from the string (and, of course, shutting off the mud pump) the balls may then be dropped into the string. Each ball has a specific gravity greater than that of the drilling mud, which specific gravity determines how fast the ball will free fall through the mud, i.e., the terminal velocity which will be achieved once the ball has been dropped. The terminal velocity is relatively slow (on the order of 10 ft/sec) if the mud pump is off such that a fair amount of time (on the order of half an hour) would be required for the balls to drop through, e.g., an 18,000 foot drill string. Thus there is a reasonable amount of time to drop balls (e.g., 10, 20, or even more) into the string, reconnect the Kelly and start the mud pump.

Once the mud pump has turned on, the velocity of the balls will naturally increase, although they will continue to maintain their pre-set distance apart. The down-hole pump is maintained in a preextended position until a ball seats in the jetting nozzle at which time a pressure surge in the string, as indicated by suitable pressure gauges located on the surface and as known in the art, will develop. At this time the cyclical compression and extension of the down-hole pump begins.

When a ball first seats in the drill bit nozzle, the down-hole pump begins its downward travel, closing the flapper valve and trapping a volume of mud between the valve and the seated ball. The mud above the closed flapper valve, of course, becomes momentarily static. The down-hole pump builds up pressure until the critical compressional force of the ball is exceeded and the ball crushes, implodes, or otherwise blows through the nozzle followed by a fluid bullet. The down-hole pump then completes its downward travel and is re-extended.

During the period which the down-hole pump is compressing and re-extending, the balls which have not yet entered the pump continue to free fall through the mud. Thus the distance between balls should take into account this distance as well, which, in practice, will be relatively short. Advantageously, by calculation or empirical determination, the distance should be tailored to the particular down-hole pump being used (i.e., its extended length and volume) so that, just as the pump is re-extended and just before the pump begins its downward travel closing the valve, a ball drops through the flapper valve as another ball is seating in the drill bit nozzle.

In the event that the crushable balls have been constructed to be hollow, the possibility does exist that both balls (i.e., the one at the seat and the one which has just entered the pump) will substantially simultaneously implode under the increased pressure in the pump as it closes. In this event, the balls can be suitably distanced so that, at most, only one ball is in the pump during a compression/re-extension cycle. This of course means that some (e.g., alternate) non-ball jetting cyles will result. Simultaneous implosion when more than one ball is in the pump generally will not occur when the crushable balls are of solid construction.

FIG. 2 is an enlargement of that portion of FIG. 1 showing a crushable ball seated in jetting nozzle 50. From FIG. 2 one can see that a ball seated in the jetting nozzle is subject to two different pressures—(1) the pressure inside the bit created by the down-hole pump squeezing the ball from all directions except the area of the orifice of the nozzle. The downward portion of the ball circumscribed by the cylindrical cross-section of the nozzle itself is subject only to the second of these pressures (2) the hydrostatic bottom hole pressure of the drilling mud column which occupies the annulus around the string. Additionally, as indicated by FIG. 2, the nominal size, e.g. diameter of the crushable ball used to plug a nozzle of any particular cross-sectional area is larger than that area. For example, the ball used to plug a one inch hole could be any diameter from just slightly larger than the nozzle orifice up to just slightly smaller than the channel diameter of nozzle 50 which it is designed to block.

The material of construction and the internal structure of the balls may thus vary according to the size of the nozzle orifice and the desired pressures at which said ball is desired to be destructed. All balls are designed, constructed, or seeded with such material that gives the balls a specific gravity heavier than that of the drilling mud in use so that the balls will descend in the mud when they are introduced at the surface.

Advantageously, a series of balls is designed to be characterized by a continuum of critical compressional forces such that particular selection of a ball from within this compressional force continuum may be effected to suit the particular rock formation which is being drilled and tailored to that formation's hardness or softness. In this regard, for example, field experience based on a drill bit having one 1-inch nozzle and two blank nozzles has shown that the down-hole pump can generate a pressure of about 2700 psi above the static downhole pressure at the bit. In this case a suitable starting compressional force to use as a lower end of the compressional force continuum would be about 3500 psi with incrementally higher crush pressures of 1000 psi up to 7500 psi. Thus the compressional force continuum might comprise a series of five different balls starting at a crush pressure of 3500 psi and augmenting this level with balls having pressures of 4500, 5500, 6500, and 7500 psi. For very soft formations, the balls at the lower end of the continuum would be very suitable. For harder formations, by contrast, it might be necessary to go to the balls characterized by higher compressional crush pressures.

The down-hole pump used in the absence of the crushable balls is able to generate downhole pressures which are greater than those capable of being generated in prior art devices not using this extensible, compressional tool. As shown above, by employing crushable balls in conjunction with the down-hole pump, downhole pressures which are as much as about three times greater than that obtainable using the down-hole pump alone can be achieved. Thus the down-hole pump/-crushable ball device can make a significant further advance in generating downhole pressures to overcome the hydrostatic pressure at the bottom of the bore hole. Correspondingly, drilling efficiency may be increased and drilling to ever greater depths made much more feasible, along with angle building at those greater depths.

A comparison of FIG. 3 with FIG. 4 qualitatively illustrates this improvement. As shown in FIG. 3, A represents the instant at which the HJD has generated a pressure sufficient to crush the ball. That portion of the graph between A and B represents the "fluid bullet" phenomenon as the drilling fluid quickly surges through the nozzle to reequilibrate itself to the pressure that would exist if the down-hole pump was operating (i.e., compressing under an applied weight of the drill string) in the absence of the crushable balls, as indicated by the section from B to C. C represents the point at which the HJD is fully compressed, with the section between C and D representing the pressure at the bit swiftly reequilibrating to the static downhole level. Ideally in the space of time as indicated by the section from D to $D_1$, the down-hole pump has been reextended, a new ball has been reseated and the pump has again started its downward travel such that a new pressure level has been reestablished as at $A_1$ at a level at which the newly seated ball is again ready to disintegrate. Thus the cyclical nature of the enhanced drilling effect, and the preferred timing (i.e., maintaining a substantially constant distance between balls as they are dropped into the drill string such that the seating of the balls is synchronized with the extension of the pump) is illustrated.

By contrast, FIG. 4 shows the normal jetting cycle for a down-hole pump alone. E indicates the point at which the pump has been fully extended and has started its downward travel. The section of the graph extending from E to F thus represents relatively constant travel of the pump, and therefore a fairly constant relatively high pressure stream of drilling fluid impinging against the bore hole wall. At F, the pump has been fully compressed, the section of graph between F and G representing the virtually instantaneous return of the pressure at the bit to the static downhole equilibrium level. The section of the graph between G and $E_2$ represents the amount of time it has taken for the pump to be reextended and to start a new high pressure cycle. This amount of time in practice can be varied within reasonably wide limits at the discretion of the operator and depending on the mechanical strength of the particular drilling rig being used. For example, given a rig having a strong draw works, the drill string can be picked up relatively quickly and the pump will also quickly be re-extended. Thus the cyclical compression/re-extension can be manipulated by an operator such that drilling speed can be tailored to a particular formation.

Thus, the difference between FIG. 3 and FIG. 4 is that the high pressure drilling fluid pulse as between A and B in FIG. 3 is not present in FIG. 4 since, without the crushable balls, no higher pressure pulses are generated.

It should be noted that the inventive development consists essentially in blocking drill bit nozzle orifices to build up the pressure exerted by drilling fluid within a drill string. Although one exemplary embodiment employs disintegratable balls to accomplish this, any other variation accomplishing the blocking is equally comprehended by the scope of the appended claims. Thus, one skilled in the art could implement an embodiment wherein the jetting nozzle is valved and wherein said valve is blown open after some suitable and, perhaps, predetermined pressure level has been reached. Such a valve might be constructed to voluntarily open in response to a particular signalling downhole pressure level. Nonetheless, all such means, objects, etc., for blocking nozzles or nozzle orifices are well within the scope of this invention. Moreover, the inventive developments presented herein are predicated on using any crushable or disintegratable object to block a drill bit nozzle or nozzle orifice. As such, the invention is not to be misconstrued as being limited only to substantially spheroidally shaped objects such as balls. Any object suitable for blocking, plugging etc. a drill bit nozzle and which will crush at a predetermined pressure level is within the scope of the appended claims, regardless of object shape.

Thus, as described above for a presently preferred exemplary embodiment (using the down-hole pump concept), our method for drilling a well bore hole using a drill string which includes an extensible hydraulic cylinder and piston section (i.e., the downhole pump) above a drill bit having therein at least one fluid jetting nozzle may include:

(a) positioning the extensible section in a substantially extended condition, (b) causing an object, which is disintegratable by a compressional force in excess of a predetermined level of force to descend through said drill string and block at least one nozzle, and (c) compressing the extensible section thus increasing the level of force acting on the nozzle to a level in excess of said predetermined level such that said disintegratable object is forced through the nozzle and such that pressurized fluid is jetted through the nozzle.

In particular, this method may be adapted to achieve an improved directional drilling or angle building method, by including as the bottom portion of the extensible section a drill bit having one or more angled jetting nozzles, at least one of which is of relatively larger cross-sectional area than the others. At large vertical depths, the smaller nozzles may be blanked, as previously mentioned. In order to deviate a bore hole from its vertical path, the drill bit is oriented so that the large cross-sectional nozzle will direct the flow of drilling mud against the lateral surface of a bore hole in the direction it is desired for the bore hole to take. The desired number of balls are then dropped into the string, the Kelly is attached, the mud pump is turned on and the cyclical compresion/extension of the down-hole pump commenced as soon as a ball seats in the jetting nozzle as indicated by a pressure surge. The method thus includes using a drill string which includes an extensible hydraulic cylinder and piston section (i.e. down-hole pump) above a drill bit having therein at least one fluid jetting nozzle through which a relatively greater amount of drilling mud can be caused to flow than through other bit nozzles, said method comprising the steps of:

(a) orienting said drill bit so that said fluid nozzle is generally directed in the direction it is desired to deviate the bore hole;

(b) positioning the extensible section in a substantially extended position;

(c) causing an object, which is disintegratable by a compressional force in excess of a predetermined level of force to descend through said drill string and block said nozzle; and (d) compressing the extensible section thus increasing the level of force acting on the nozzle to a level in excess of said predetermined level such that said disintegratable object is forced through the nozzle and such that pressurized fluid is jetted through the nozzle.

The presently preferred embodiment (i.e., with the down-hole pump) has been described above. However, the invention may be used with any jet drilling system, not simply the down-hole pump. The pump is preferred for use in the present invention because the volume of trapped fluid is relatively small and, given the compressibility of drilling fluid, the pressure surge which gives rise to the fluid bullet is developed relatively quickly. By using the crushable balls in a conventional drill string wherein the volume of fluid in the entire drill string would need to be compressed in order to build up suitably high pressures to develop a fluid surge, said pressures would develop much more slowly than with the HJD given the greater amount of drilling fluid to compress. Nonetheless, the principle of using a crushable/shearable/frangible/disintegratable (which terms are used interchangeably in this specification and in the appended claims) ball which suddenly unblocks the fluid jet outlet at a critical pressure level is suitable for use with conventional drilling systems not involving a down-hole pump, and improvements can be made over that conventionally obtainable in these systems as well. Our method as applied to non-down-hole pump drilling systems may comprise a method for drilling a well bore hole using a drill string having on its lowermost portion a drill bit having at least one fluid jetting nozzle therein, such as the following:

(a) causing an object which is disintegrable by a compressional force in excess of a predetermined level of force to descend through said drill string and block at least one nozzle, and (b) increasing said level of force acting on the nozzle to a level sufficient to force said disintegrable object through the nozzle with a pulse of pressurized fluid.

Those skilled in the art will appreciate that such a conventional drilling system can also be employed for directional drilling or angle building in a manner analogous to that previously described for use with a down-hole pump. In this case our method for deviating a bore hole at an angle with the vertical includes using a drill string having a jetting drill bit having therein at least one fluid jetting nozzle through which a relatively greater amount of drilling mud can be caused to flow than through other bit nozzles, said method comprising the steps of:

(a) orienting said drill bit so that the fluid nozzle is generally directed in the direction it is desired to deviate the bore hole;

(b) causing an object which is disintegratable by a compressional force in excess of a predetermined level to descend through said drill string and block said nozzle; and (c) increasing the level of force acting on said object to increase a level in excess of said predetermined level such that said disintegratable object is forced through said nozzle and such that pressurized fluid is jetted through the nozzle.

While balls have been used and are known to those skilled in the art of well drilling, they have been used in applications completely different from those of this invention. For example, they have been used to block up the nozzles of a drill bit so that a drilling fluid "hammer blow" could be delivered to jar the drill string loose from a key seat. Alternatively, balls have been used to block up one or more eroded nozzles so that fluid pressure through remaining nozzles could be desirably increased, or to block nozzles to circumvent fluid surges which would otherwise result from raising or lowering the drill string. No prior art known to applicants discloses, however, the use of frangible or crushable balls to aid directly in the drilling action per se.

It will be apparent to those skilled in the art that many variations may be made in the preferred exemplary embodiments while yet retaining many of the novel and advantageous features of this invention. Accordingly, all such modifications and variations are intended to be within the scope of the following claims.

What I claim is:

1. A method for drilling a well bore hole using a drill string having on its lowermost portion a drill bit having at least one fluid jetting nozzle, said method comprising:

(a) causing an object which is disintegratable by a compressional force in excess of a predetermined level to descend through a pressurized fluid in said drill string and block said at least one nozzle;

(b) increasing the level of fluid pressure acting on said object until it is crushably forced through said nozzle to cause a pulse of pressurized fluid to be thereafter jetted through said at least one nozzle; and (c) cyclically repeating said steps (a) and (b) such that a ball is caused to seat in said at least one nozzle at substantially the same time that said fluid pressure has been reestablished by the jetting of fluid through said nozzle.

2. A method for drilling a well bore hole using a drill string which includes an extensible hydraulic cylinder and piston section above a drill bit having therein at least one fluid jetting nozzle, said method comprising:

(a) positioning said extensible section in a substantially fully extended condition, (b) causing an object disintegratable by a compressional force in excess of a predetermined level of fluid pressure force to descend through pressurized fluid in said drill string and to block said at least one nozzle while said extensible section is substantially fully extended;

(c) increasing the level of fluid pressure force by causing said drill string to lower and close said extensible section such that said disintegratable object is forced through said nozzle with a pulse of pressurized fluid being thereafter jetted through said at least one nozzle; and (d) cyclically repeating said steps (a), (b) and (c) such that a ball is caused to seat in said at least one nozzle at substantially the same time that said fluid pressure has been reestablished by the jetting of fluid through said nozzle.

3. A method for deviating the direction taken by a bore hole towards a particular direction, said method comprising the steps of:

(a) orienting a jetting drill bit having at least one fluid outlet orifice through which a relatively greater amount of drilling mud can be caused to flow than through other orifices so that said at least one orifice is generally directed towards said particular direction and is adjacent the lowermost portion of the interior surface of a bore hole into which said drill bit is to proceed, said drill bit being located at the lowermost portion of a drill string;

(b) causing an object which is disintegratable by a compressional force in excess of a predetermined level to descend through a pressurized fluid in said drill string and block said at least one nozzle;

(c) increasing the level of fluid pressure acting on said object until it is crushably forced through said nozzle to cause a pulse of pressurized fluid to be thereafter jetted through said at least one nozzle; and (d) cyclically repeating said steps (a), (b) and (c) such that a ball is caused to seat in said at least one nozzle at substantially the same time that said fluid pressure has been reestablished by the jetting of fluid through said nozzle.

4. A method for deviating the direction taken by a bore hole towards a particular direction, said method comprising the steps of:

(a) orienting a jetting drill bit having at least one fluid outlet orifice through which a relatively greater amount of drilling mud can be caused to flow than through other orifices so that said at least one orifice is generally directed towards said particular direction and is adjacent the lowermost portion of the interior surface of a bore hole into which said drill bit is to proceed, said drill bit being located below and connected to an extensible hydraulic cylinder and piston section disposed at the lowermost portion of a drill string;

(b) positioning said extensible section in a substantially fully extended position;

(c) causing at least one object which is disintegratable by a compressional force in excess of a predetermined level to descend through said drill string and seat in said at least one fluid outlet orifice;

(d) pressurizing fluid in said etensible section to a level in excess of said predetermined level such that said disintegratable object is forced through said at least one fluid outlet orifice with a pulse of pressurized fluid being thereafter jetted through said at least one fluid outlet orifice; and (e) cyclically repeating said steps (a), (b), (c) and (d) such that a ball is caused to seat in said at least one nozzle at substantially the same time that the fluid pressure has been reestablished by the jetting of fluid through said nozzle.

* * * * *